US007568639B2

(12) United States Patent
Yip

(10) Patent No.: US 7,568,639 B2
(45) Date of Patent: Aug. 4, 2009

(54) UTILITY HAND-PIECE WITH INTEGRATED FLUID CHANNEL

(75) Inventor: Jennifer Yip, Cornelius, NC (US)

(73) Assignee: Ronda Yip, San Jose, CA (US)

( * ) Notice: Subject to any disclaimer, the term of this patent is extended or adjusted under 35 U.S.C. 154(b) by 0 days.

(21) Appl. No.: 11/895,663

(22) Filed: Aug. 27, 2007

(65) Prior Publication Data

US 2008/0140031 A1 Jun. 12, 2008

Related U.S. Application Data

(63) Continuation-in-part of application No. 11/634,421, filed on Dec. 6, 2006.

(51) Int. Cl.

| | |
|---|---|
| ***B05B 9/08*** | (2006.01) |
| ***B05B 7/02*** | (2006.01) |
| ***A62C 15/00*** | (2006.01) |
| ***B05B 1/00*** | (2006.01) |
| ***B05B 11/00*** | (2006.01) |
| ***B67D 5/64*** | (2006.01) |

(52) U.S. Cl. ..... 239/529; 239/152; 239/211; 239/525; 222/78; 222/175

(58) Field of Classification Search ..... 239/154, 239/211, 529, 152, 525; 222/78, 175; 401/7, 401/8; 119/665; 15/222; 2/160
See application file for complete search history.

(56) References Cited

U.S. PATENT DOCUMENTS

| | | | | |
|---|---|---|---|---|
| 1,533,732 | A * | 4/1925 | Frost | 239/529 |
| 1,558,930 | A * | 10/1925 | Schuck | 239/529 |
| 1,587,873 | A * | 6/1926 | Stone | 239/443 |
| 1,620,698 | A * | 3/1927 | Stone | 239/529 |
| 2,132,459 | A * | 10/1938 | Cockeroft | 239/529 |
| 4,903,864 | A * | 2/1990 | Sirhan | 222/78 |
| 5,158,208 | A * | 10/1992 | Wilson | 222/78 |

* cited by examiner

*Primary Examiner*—Len Tran
*Assistant Examiner*—Ryan Reis
(74) *Attorney, Agent, or Firm*—Schwartz Law Firm, P.C.

(57) ABSTRACT

A utility hand-piece is adapted for being worn on a hand of a user. The hand-piece includes a body portion adapted for covering at least a portion of the hand, and incorporating at least one fluid channel. A fluid inlet is formed with the body portion and communicates with the fluid channel. A fluid outlet is formed with the body portion and communicates with the fluid channel downstream of the fluid inlet. Upon connecting a fluid source to the hand-piece, fluid is transferred from the fluid inlet through the fluid channel and dispensed from the body portion through the fluid outlet.

4 Claims, 10 Drawing Sheets

UTILITY HAND-PIECE WITH INTEGRATED FLUID CHANNEL

TECHNICAL FIELD AND BACKGROUND OF THE INVENTION

This invention relates to a utility hand-piece with an integrated fluid channel. The invention is especially applicable for receiving and dispensing a fluid, such as water, air, steam, oils, shampoo, hair conditioner, lotions, creams, and other fluid/gel products. In one exemplary implementation, the invention is used in the spa and massage therapy industry as a fluid dispensing implement for facials, body massages, pedicures, manicures, and the like. The invention has application in a wide variety of other industries including health care, pet care, industrial cleaning, house cleaning, food preparation, personal hygiene, vehicle and boat washing. Other exemplary applications include cleaning and bathing babies, toddlers, and disabled, invalid, and elderly persons.

SUMMARY OF THE INVENTION

Therefore, it is an object of the invention to provide a utility hand-piece which incorporates at least one integrated fluid channel.

It is another object of the invention to provide a utility hand-piece which is applicable in personal spa treatments including facials, manicures, pedicures, and body massages.

It is another object of the invention to provide a utility hand-piece which allows free use of the hand and fingers while simultaneously dispensing a fluid, such as (for example) water, air, steam, oils, shampoo, hair conditioner, lotions, creams, and other fluid/gel products.

It is another object of the invention to provide a utility hand-piece which is applicable in a wide variety of industries including, for example, spa and massage therapy, nursing homes, hospitals, restaurants, and industrial plants.

These and other objects of the present invention are achieved in the exemplary embodiments disclosed below by providing a utility hand-piece for being worn on a hand of a user. The hand-piece includes a body portion adapted for covering at least a portion of the hand, and defining at least one fluid channel therein. The fluid channel may be integrally formed with the body portion, or formed separately using, for example, a flexible tube or the like (as described further below). A fluid inlet is formed with the body portion and communicates with the fluid channel. A fluid outlet is formed with the body portion and communicates with the fluid channel downstream of the fluid inlet. Upon connecting a fluid source to the hand-piece, fluid is transferred from the fluid inlet through the fluid channel and dispensed from the body portion through the fluid outlet.

According to another exemplary embodiment of the invention, the body portion defines a plurality of divided fluid channels therein communicating with the fluid inlet.

According to another exemplary embodiment of the invention, a plurality of fluid outlets communicate with respective fluid channels.

According to another exemplary embodiment of the invention, the body portion defines three divided fluid channels therein communicating with the fluid inlet.

According to another exemplary embodiment of the invention, at least three fluid outlets communicate with respective fluid channels.

According to another exemplary embodiment of the invention, the body portion includes at least one finger opening adapted for receiving a finger of the user.

According to another exemplary embodiment of the invention, the finger opening is a finger loop.

According to another exemplary embodiment of the invention, the body portion includes a plurality of finger openings adapted for receiving respective fingers of the user.

According to another exemplary embodiment of the invention, a plurality of fluid outlets are located proximate respective finger openings.

According to another exemplary embodiment of the invention, an adjustable wrist strap is attached to the body portion and adapted for wrapping around a wrist of the user.

According to another exemplary embodiment of the invention, the body portion incorporates overlying top and bottom layers, and the fluid channel is integrally formed between the top and bottom layers.

In yet another exemplary embodiment, the invention is a utility hand-piece for being worn on a hand of a user, and including a flexible (e.g., back-of-the-hand) body portion and at least one fluid transfer tube. The flexible body portion is adapted for covering at least a portion of the hand, and comprises at least first and second overlying layers. The multiple layers may be superimposed in substantial registration along respective sides and/or ends; or alternatively, the second layer may only partially cover the first, or vice-versa; or alternatively, either of the first or second layers may comprise merely one or more loops or other structure sufficient for securing the tube to the other layer. At least one of the first and second layers defines at least one fluid discharge port therein. A fluid-transfer tube extends between the first and second layers of the body portion, and defines a fluid channel having an inlet adapted for communicating with a source of fluid and an outlet adjacent the discharge port. Upon connecting a fluid source to the hand-piece, fluid is transferred from the inlet through the fluid channel and dispensed from the body portion through the discharge port.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF EXEMPLARY EMBODIMENTS AND BEST MODE

The present invention is described more fully hereinafter with reference to the accompanying drawings, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Like numbers refer to like elements throughout. As used herein, the article "a" is intended to include one or more items. Where only one item is intended, the term "one" or similar language is used. Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. Any references to advantages, benefits, unexpected results, or operability of the present invention are not intended as an affirmation that the invention has been previously reduced to practice or that any testing has been performed.

Figure 1:
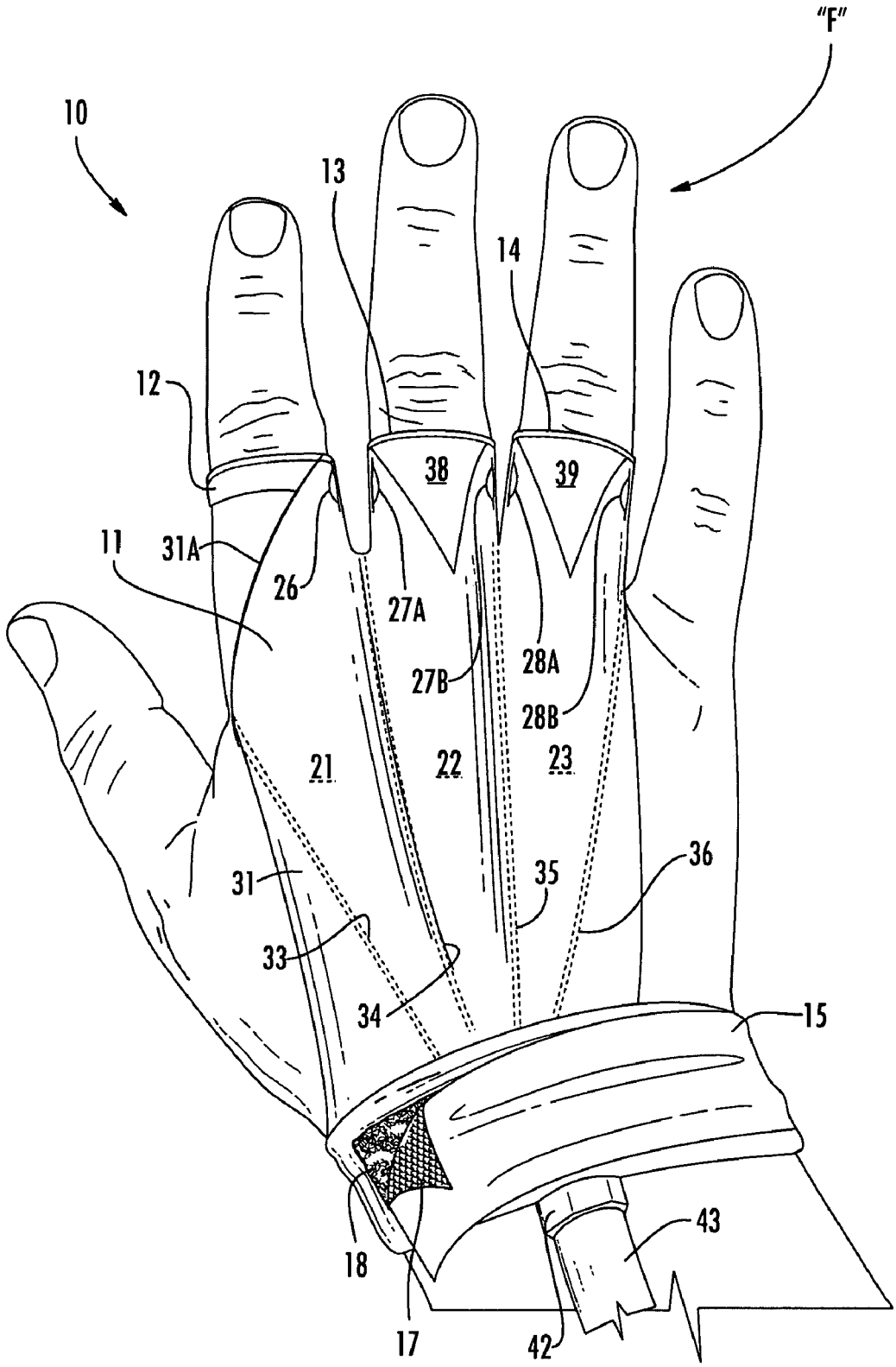
FIG. 1 is an environmental view of the hand-piece according to one exemplary implementation of the present invention, and showing the hand-piece worn on the hand of a user.
Figure 2:
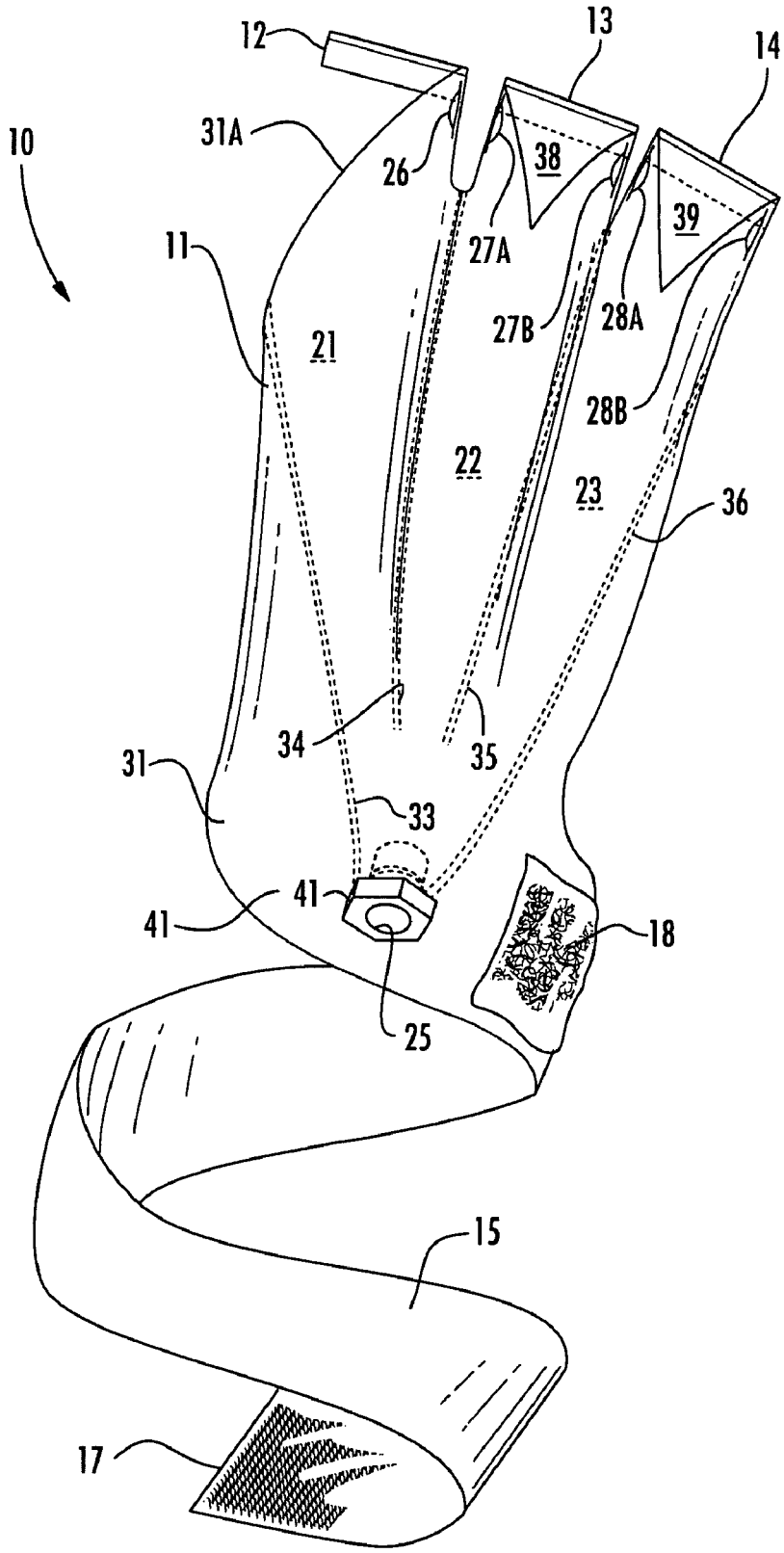
FIG. 2 is a perspective view of the hand-piece removed from the hand.

Referring now specifically to the drawings, a utility hand-piece according to one exemplary embodiment of the present invention is illustrated in FIGS. 1 and 2, and shown generally at reference numeral 10. The hand-piece 10 is particularly applicable for use in the spa and massage therapy industry. In one exemplary implementation, the hand-piece 10 comprises a flexible open-palm body portion 11, finger loops 12, 13, and 14, and a wrist strap 15. The wrist strap 15 wraps around the wrist of the user, and has complementary hook and loop fasteners 17 and 18 which selectively mate together to allow an adjustable fit. The body portion 11 of the hand-piece 10 incorporates divided fluid channels 21, 22, and 23 designed for receiving water, oils, shampoo, hair conditioner, lotions, creams, and other fluid/gel products. Each of the fluid channels 21, 22, 23 communicates with an inlet 25 formed near the wrist strap 15, and a number of relatively small dispenser ports 26, 27A, 27B, and 28A, 28B formed downstream of the inlet 25 near the finger loops 12, 13, and 14. The dispenser ports 26, 27A, 27B, and 28A, 28B may be strategically located to dispense product outwardly between the fingers of the user.

Figure 3:
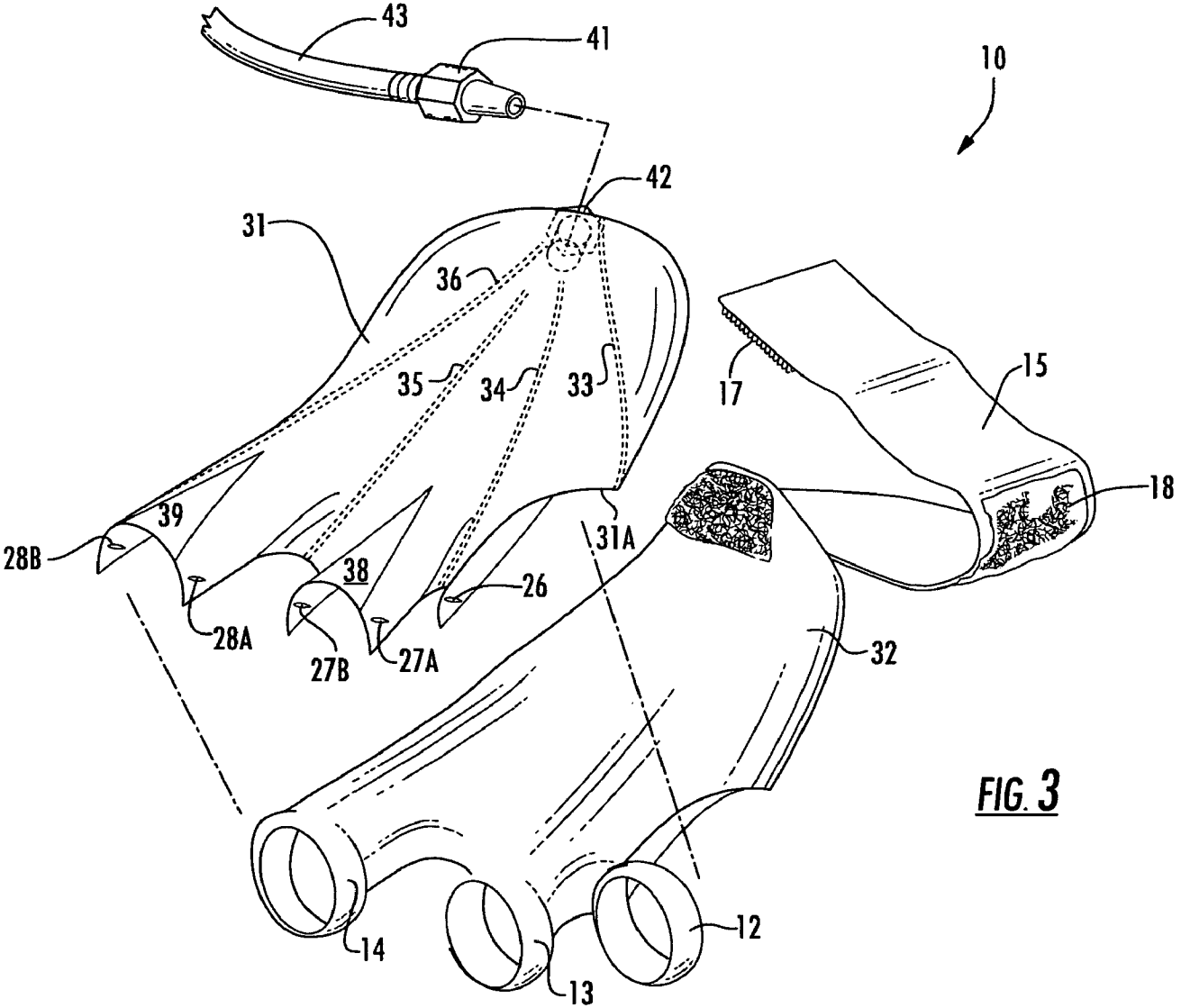
FIG. 3 is an exploded view of the hand-piece showing the top layer pulled away from the bottom layer.
Figure 4:
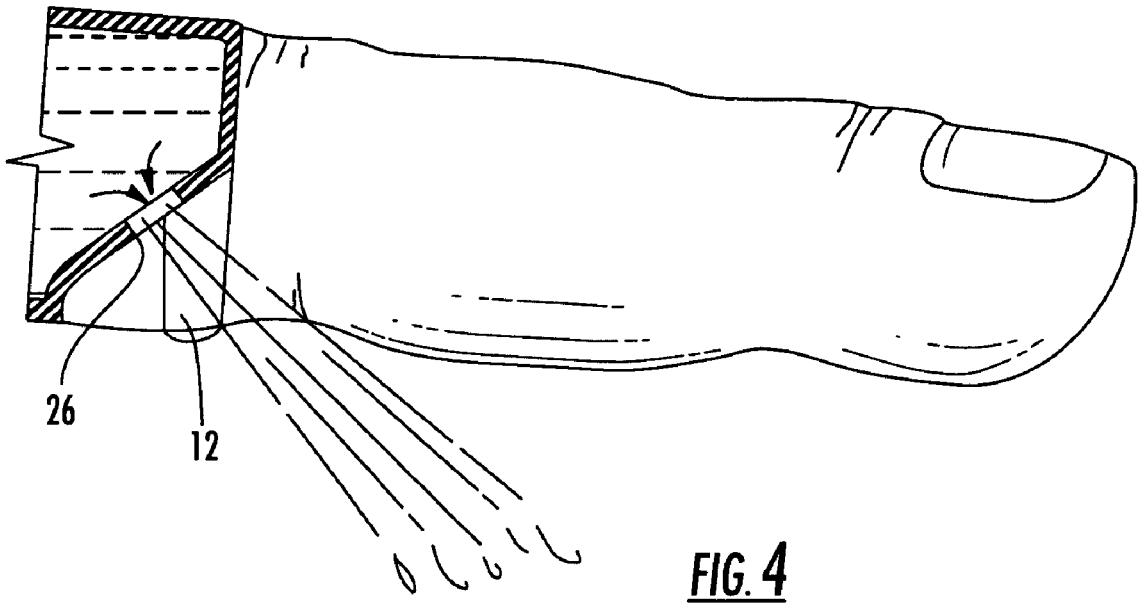
FIG. 4 is an enlarged, fragmentary cross-section showing a dispenser port of the hand-piece, and demonstrating the dispensing of fluid outwardly towards a palm-side of the hand.
Figure 5:
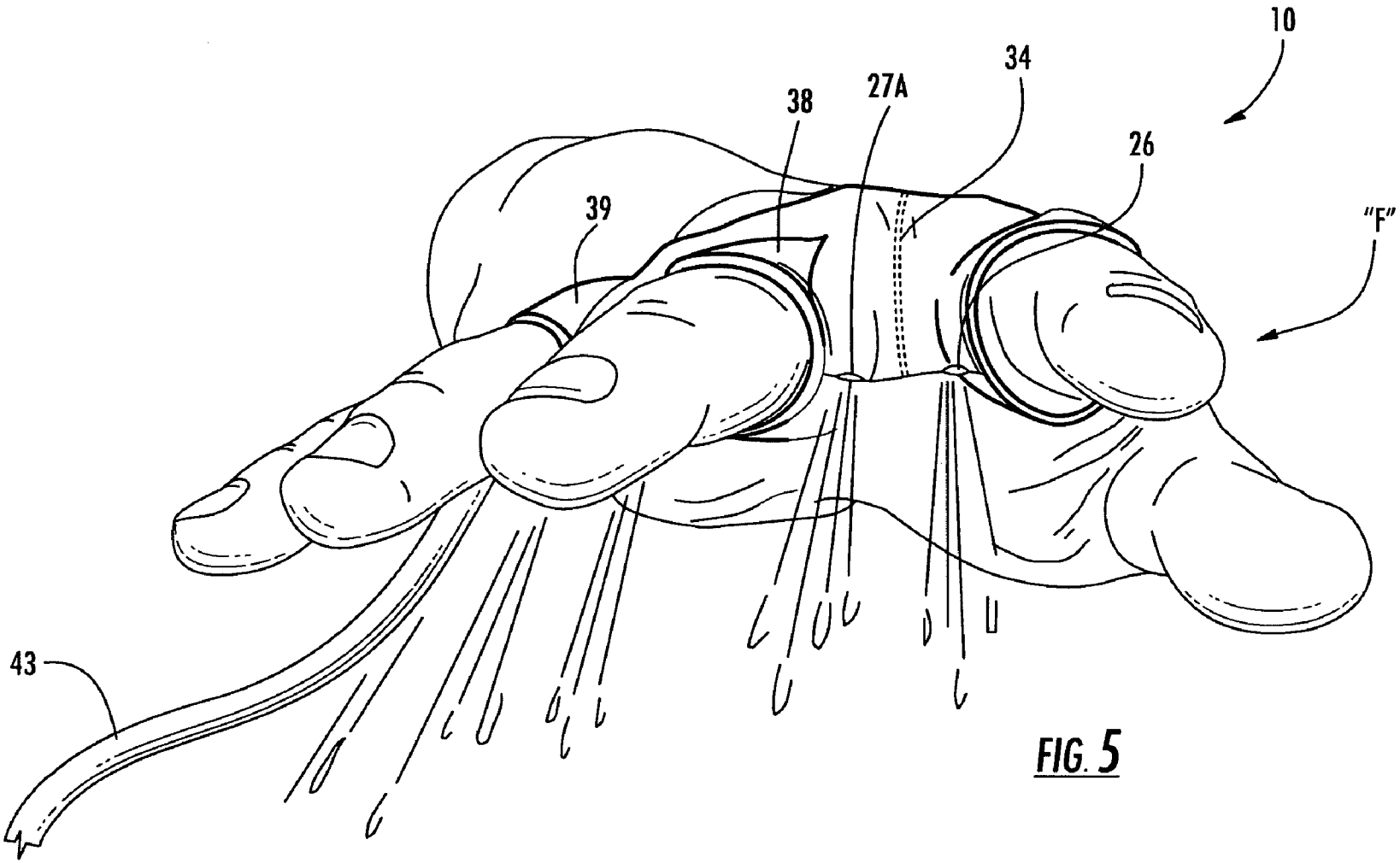
FIG. 5 is a further environmental view of the hand-piece shown on the hand of a user, and demonstrating the dispensing of fluid outwardly between the fingers and towards a palm-side of the hand.

In one embodiment, the hand-piece 10 comprises overlying top and bottom layers 31 and 32 (shown in FIG. 3) formed of a soft and stretchable neoprene, and joined together along a perimeter edge 31A of the top layer 31 and at intermediate longitudinal channel lines 33, 34, 35, and 36. The top and bottom layers 31, 32 may be joined together using a substantially water-tight, single or double fluid seam weld construction. The seams 31A, 33, 34, 35, 36 may also be stitchless and glued, glued and blind-stitched, taped, or formed in any other suitable manner creating a substantially water-tight connection. Fluid channel 21 extends from the inlet 25 to dispenser port 26, and is formed between the top and bottom layers 31, 32 and between channels lines 33 and 34. Fluid channel 22 extends from the inlet 25 to dispenser ports 27A, 27B, and is formed between the top and bottom layers 31, 32 and between channels lines 34 and 35. Fluid channel 23 extends from the inlet 25 to dispenser ports 28A, 28B, and is formed between the top and bottom layers 31, 32 and between channels lines 35 and 36. As best shown in FIGS. 4 and 5, each dispenser port 26, 27A, 27B, and 28A, 28B may be formed to direct fluid outwardly between the fingers "F" and towards a palm side of the hand. In addition, triangular areas 38 and 39 of the top layer 31 adjacent the finger loops 13 and 14 may be adhered directly to the bottom layer 32 in order to divert fluid flow to opposite sides of respective fingers.

Referring again to FIGS. 1 and 3, the fluid inlet 25 may comprise a sealed male or female connector 41 formed with the body portion 11, and designed to mate with a complementary connector 42 located at a free end of a flexible fluid transfer tube 43. The opposite end of the fluid transfer tube 43 communicates with a source of fluid, and may be operatively connected to a foot pump, water tap or spout, or other means suitable for urging fluid through the tube 43 and into the hand-piece 10. The hand-piece 10 is especially useful in spa treatments, such as facials and body massages, leaving both hands and all fingers of the user free to touch and massage the customer.

Figure 6:
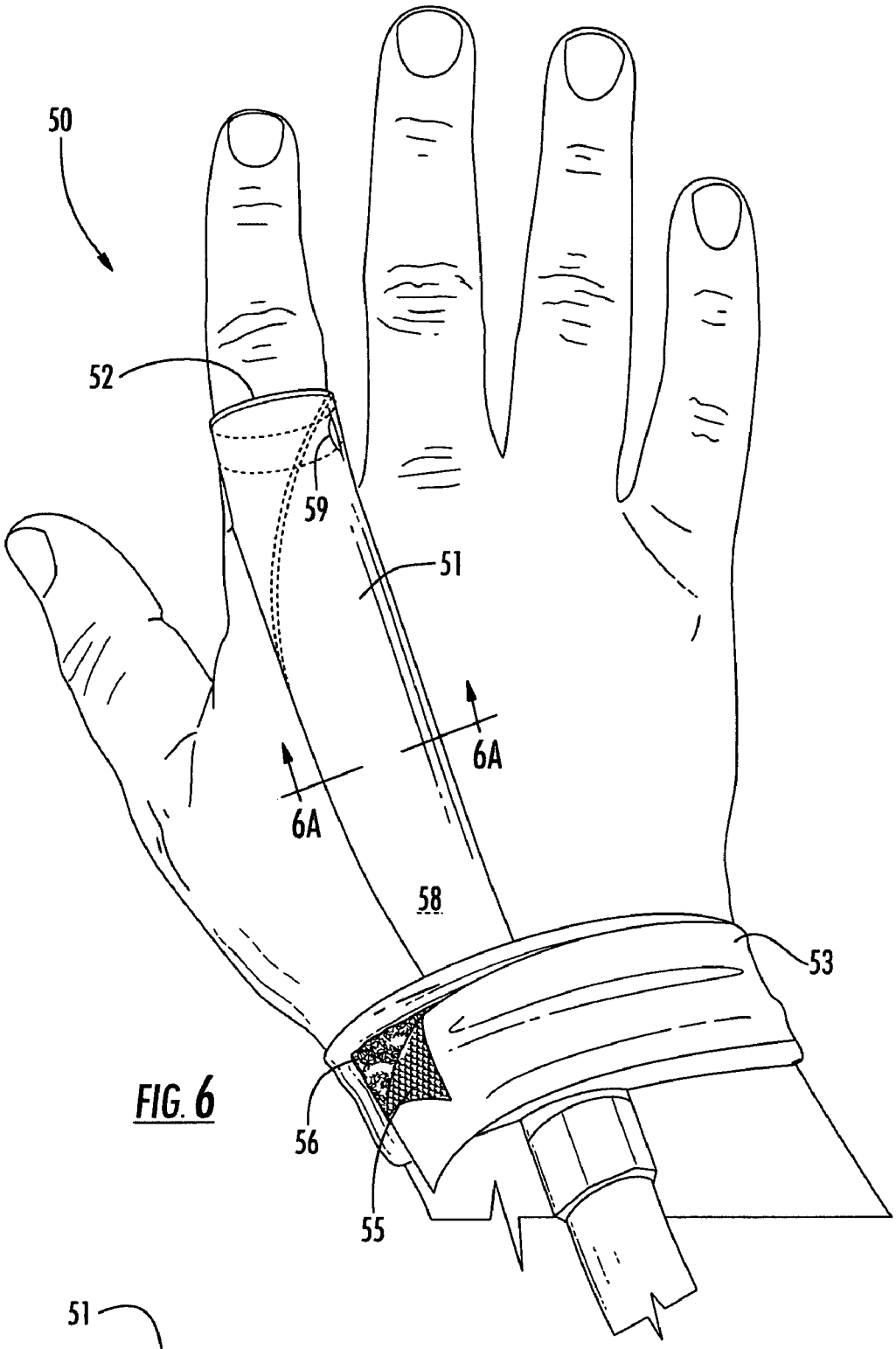
FIG. 6 is a perspective view of the hand-piece according to a further exemplary embodiment of the invention.
Figure 6A:
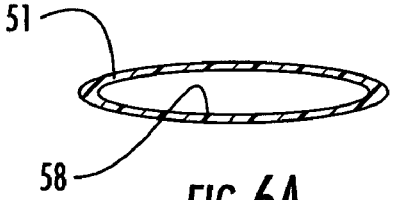
FIG. 6A is a cross-sectional view taken substantially along line 6-6 of FIG. 6.

An alternative implementation of the invention is illustrated in FIGS. 6 and 6A. The hand-piece 50 comprises a flexible tubular body portion 51, a single finger loop 52, and a wrist strap 53. As previously described, the wrist strap 53 wraps around the wrist of the user, and has complementary hook and loop fasteners 55 and 56 which selectively mate together to allow an adjustable fit. The body portion 51 of the hand-piece 50 defines an internal fluid channel 58 designed to receive a fluid. The fluid channel 58 communicates with an inlet (not shown) formed near the wrist strap 53, and a relatively small dispenser port 59 formed near the finger loop 52. The fluid inlet is preferably identical to that shown in FIG. 2, and may comprise a male or female connector formed with the body portion 51 and designed to mate with a complementary connector located at a free end of the fluid transfer tube. The hand-piece 50 operates to receive and dispense fluid in a manner identical to that previously described.

Figure 7:
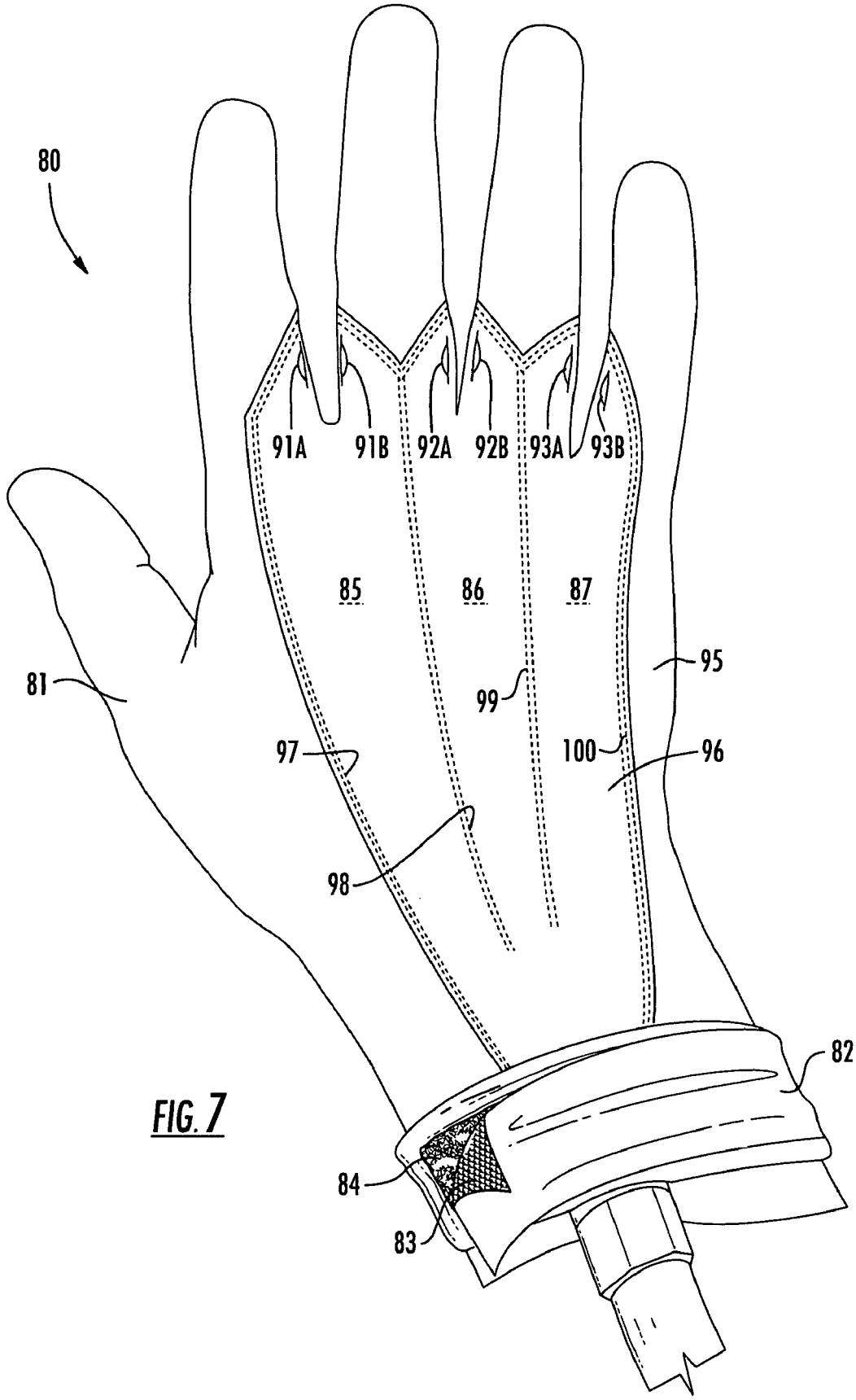
FIG. 7 is a perspective view of yet another embodiment of the hand-piece.

A further alternative implementation of the invention is illustrated in FIG. 7. The hand-piece 80 comprises a flexible body portion 81 and a wrist strap 82. As previously described, the wrist strap 82 wraps around the wrist of the user, and has complementary hook and loop fasteners 83 and 84 which selectively mate together to allow an adjustable fit. The body portion 81 of the hand-piece 80 incorporates divided fluid channels 85, 86, and 87 designed to receive and deliver a fluid at or near the fingers of the user. The fluid channels 85, 86, and 87 communicate with an inlet (not shown) formed near the wrist strap 82, and relatively small dispenser ports 91A, 91B, 92A, 92B, and 93A, 93B formed near the fingers of the body portion 81. The fluid inlet is preferably identical to that shown in FIG. 2, and may comprise a sealed male or female connector formed with the body portion 81 and designed to mate with a complementary connector located at a free end of the fluid transfer tube.

The body portion 81 of the hand-piece 80 comprises a full glove base 95 designed to cover the entire hand, and a separate overlying top layer 96. The glove base 95 has five finger openings for receiving the fingers and thumb of the user, respectively. The top layer 96 and at least an underlying outer surface of the glove base 95 may be formed of a soft, stretchable neoprene. The top layer 96 is joined to the glove base 95 along longitudinal channel lines 97, 98, 99, and 100 using a substantially water-tight, single or double fluid seam weld construction. The seams 97-100 may also be stitchless and glued, glued and blind-stitched, taped, or formed in any other suitable manner creating a substantially water-tight connection. Fluid channel 85 extends from the inlet to dispenser ports 91A, 91B, and is formed between the top layer 96 and glove base 95, and between channel lines 97 and 98. Fluid channel 86 extends from the inlet to dispenser ports 92A, 92B and is formed between the top layer 96 and glove base 95, and between channels lines 98 and 99. Fluid channel 87 extends from the inlet to dispenser ports 93A, 93B and is formed between the top layer 96 and glove base 95, and between channels lines 99 and 100.

Like hand-piece 10 described above, each dispenser port 91A, 91B, 92A, 92B, and 93A, 93B may be formed to direct fluid outwardly between the fingers and towards a palm side of the hand. The hand-piece 80 operates to receive and dispense fluid in a manner identical to that previously described. The hand-piece 80 is particularly useful in industrial applications involving liquid cleaning products, and in nursing homes and hospitals for bathing and washing patients.

Figure 8:
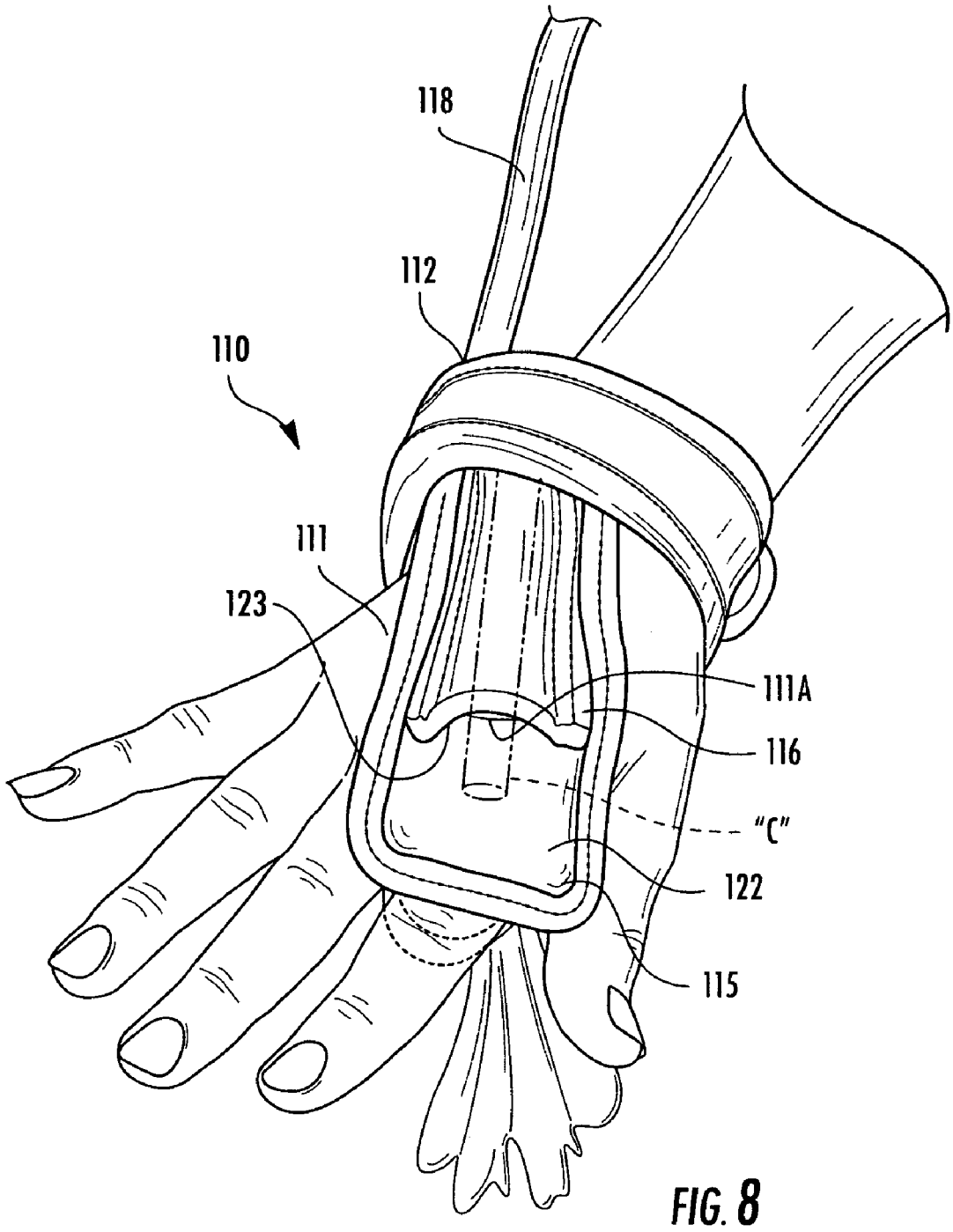
FIG. 8 is an environmental view of the hand-piece according to a further exemplary embodiment, and demonstrating the dispensing of fluid outwardly towards a palm-side of the hand.
Figure 9:
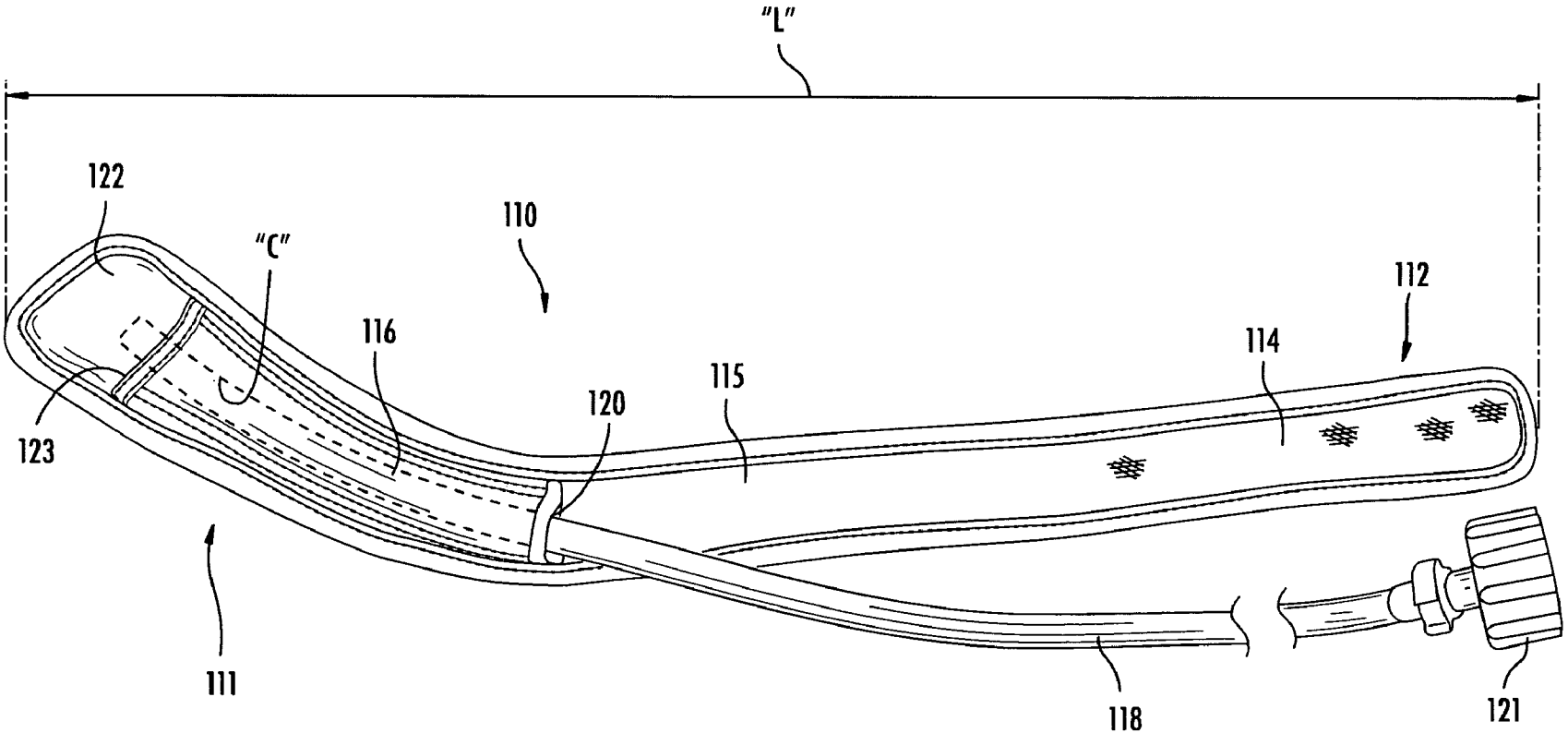
FIG. 9 is a top side view of the hand-piece removed from the hand, and laid substantially flat; the top side being the side of the hand-piece which faces away from the hand when in-use.
Figure 10:
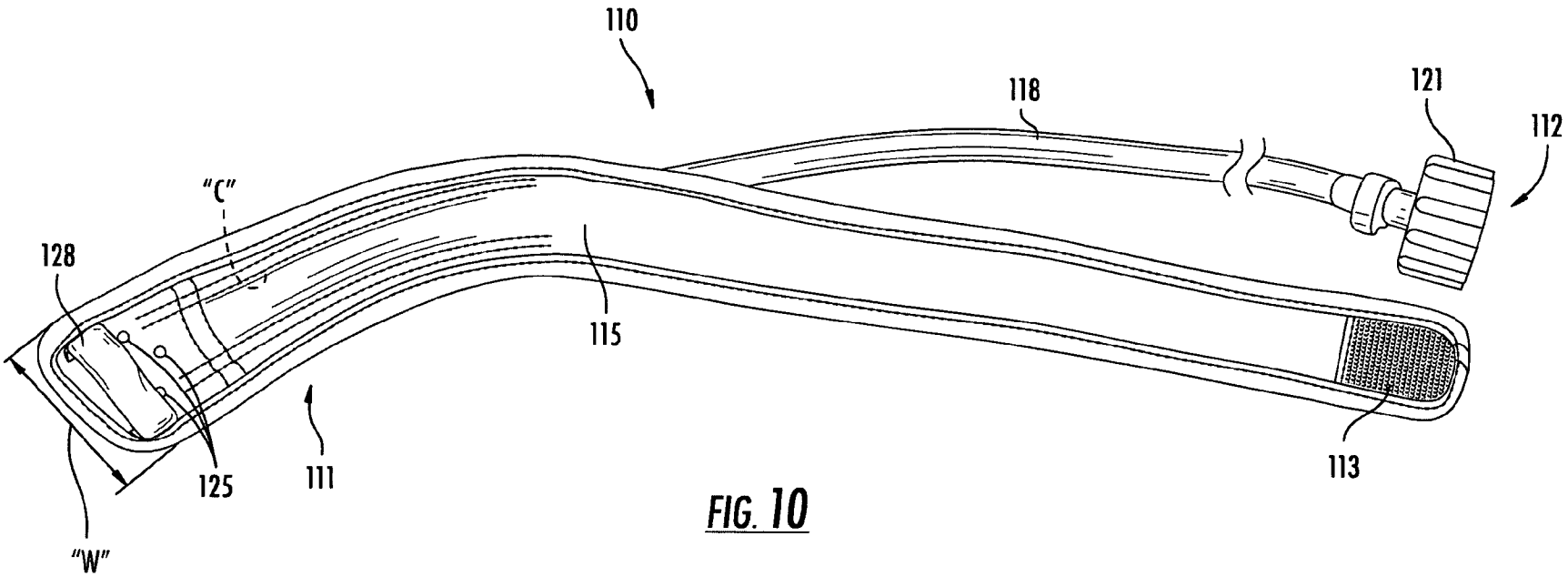
FIG. 10 is a bottom side view of the hand-piece removed from the hand, and laid substantially flat; the bottom side being the side of the hand-piece which faces towards the hand when in-use.

Yet another exemplary embodiment of a hand-piece 110 according to the present invention is shown in FIGS. 8-10. The hand-piece 110 comprises a flexible body portion 111 and an integrally-formed wrist strap 112. The body portion 111 and wrist strap 112 may be constructed of any suitable fabric or other material, including a soft and stretchable neoprene. The wrist strap 112 may be adjustably secured around the wrist of the user, as shown in FIG. 8, and has an end patch 113 of hook fasteners on one side designed to mate with complementary loop fasteners 114 on an opposite side. See FIGS. 9 and 10. The loop fasteners 114 may be formed over an entire outer surface of the wrist strap 112, or in less extensive designated locations.

The body portion 111 of the hand-piece 110 comprises a base layer 115, an overlying and separately attached top layer 116, and a substantially leak-free longitudinal fluid channel "C" extending between the base and top layers 115 and 116. In this embodiment, the fluid channel "C" is entirely or partially formed by an elongated, flexible, fluid-transfer tube 118. The top layer 116 of the body portion 111 is joined along its opposite sides to the base layer 115, as described above, and forms an access 120 for passage of the fluid-transfer tube 118 outwardly from the body portion 111 to a free end terminating at a fluid source connector 121. In the embodiment shown, the fluid-transfer tube 118 extends into and through the access 120, and along substantially the entire length of the body portion 111. The proximal end of the tube 118 is covered by an end hood 122 adjacent the base layer 115 and top layer 116, and terminates near a tip of the body portion 111. The end hood 122 and top layer 116 may overlap slightly at a lateral seam 123, and may form an access fly for accessing the proximal end of the fluid-transfer tube 118. Alternatively, the proximal end of the fluid transfer tube 118 may be permanently secured (e.g., via heat-sealing or sewing stitches) to the base layer 115. The fluid-transfer tube 118 terminates inside a pocket 111A of the body portion 111 between the end hood 122 and base layer 115 and adjacent a number of fluid discharge ports 125 formed with the base layer 115, such that water (or other fluid) passing through the fluid-transfer tube 118 may flow outwardly from the hand-piece 110 towards a palm-side of the hand. See FIG. 8. The end, side, and front edges of the hood 122 may be sewn directly to the base layer 115, and a small hole (not shown) formed with end hood 122 to allow extension of the fluid-transfer tube 118 into the pocket 111A of the body portion 111. The base layer 115 may include any desired number of discharge ports 125. To facilitate and maintain proper placement of the hand-piece 110 during use, a finger loop 128 may be located at the end of the body portion 111 to receive a finger (e.g., index finger) of the wearer. Additionally, the length of the fluid-transfer tube 118 extending from the hand-piece 110 to the fluid source connector 121 may be adjusted, as desired, by interconnecting multiple lengths of flexible tube using suitable tube couplers (not shown).

In this exemplary embodiment, the maximum width "W" of the hand-piece 110 along the combined length of the body portion 111 and wrist strap 112 is approximately 1.5 inches, and within a range of 1.0 to 3.0 inches. The total length "L" of the hand-piece 110 from a free end of the body portion 111 to a free end of the wrist strap 112 is approximately 16.0 inches, and within a range of 14.0 to 18.0 inches. The wrist strap 112 may be integrally-formed (i.e., formed as a single homogenous unit) with the base layer 115 of the body portion 111, whereas the top layer 116 of the body portion 111 may be separated attached (e.g., by sewing, gluing, taping, and/or a fluid seam weld construction). Alternatively, the fluid transfer tube 118 may be attached directly to the base layer 115 of the body portion 111 by gluing, taping or other suitable means.

Exemplary embodiments of the present invention are described above. No element, act, or instruction used in this description should be construed as important, necessary, critical, or essential to the invention unless explicitly described as such. Although only a view of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

I claim:

1. A utility hand-piece for being worn on a hand of a user, said hand-piece comprising:

an elongated flexible body portion adapted for covering at least a portion of the hand, and an elongated flexible wrist strap integrally formed with said body portion and adapted for wrapping around a wrist of the user, and said body portion comprising first and second overlying layers forming an elongated tube-receiving sleeve having an open end adjacent a proximal end of said body portion and a fluid-discharge end adjacent a free end of said body portion, the first layer of said body portion defining at least one fluid discharge port at the fluid-discharge end of said tube-receiving sleeve; and a fluid-transfer tube extending through the open end of said tube-receiving sleeve and residing between the first and second layers of said body portion, and defining a fluid channel having an inlet adapted for communicating with a source of fluid and an outlet adjacent said discharge port, whereby upon connecting a fluid source to said hand-piece, fluid is transferred from said inlet through said fluid channel and dispensed from said body portion through said discharge port.

2. A utility hand-piece according to claim 1, wherein said body portion comprises a finger loop adapted for receiving a finger of the user.

3. A utility hand-piece according to claim 1, and comprising a plurality of fluid discharge ports formed with the first layer of said body portion.

4. A utility hand-piece according to claim 1, wherein said wrist strap comprises complementary hook and loop fasteners.

* * * * *